United States Patent [19]

Ellerbe et al.

[11] 4,238,068

[45] Dec. 9, 1980

[54] VARIABLE DEPTH SELF-LOCKING CONTAINER

[75] Inventors: Roger A. Ellerbe, Clemmons; Jay V. Welch; Roy L. Miller, both of Winston Salem, all of N.C.

[73] Assignee: Container Corporation of America, Chicago, Ill.

[21] Appl. No.: 81,873

[22] Filed: Oct. 4, 1979

[51] Int. Cl.[3] ..... B65D 5/10; B65D 5/02

[52] U.S. Cl. ..... 229/39 R; 229/DIG. 3

[58] Field of Search ..... 229/39 R, DIG. 3, 44

[56] References Cited

U.S. PATENT DOCUMENTS

| | | | |
|---|---|---|---|
| 646,638 | 4/1900 | Cutler | 229/DIG. 3 |
| 2,337,039 | 12/1943 | Gardner, Jr. | 229/39 R |
| 2,713,965 | 7/1955 | Acker | 229/39 R |
| 3,111,254 | 11/1963 | Thyem | 229/44 R |
| 3,251,532 | 5/1966 | Hecthnam | 229/DIG. 3 |
| 3,258,192 | 6/1966 | Keity | 229/39 R |
| 3,313,467 | 4/1967 | Anderskow et al. | 229/DIG. 3 |
| 3,337,115 | 8/1967 | Jones | 229/39 R |
| 3,371,842 | 3/1968 | Hechtman et al. | 229/DIG. 3 |
| 3,598,303 | 8/1971 | Folz | 229/DIG. 3 |
| 3,727,827 | 4/1973 | Stice | 229/DIG. 3 |
| 3,770,187 | 11/1973 | Faires et al. | 229/39 R |
| 4,017,017 | 4/1977 | Vos | 229/DIG. 3 |
| 4,136,817 | 1/1979 | Perry | 229/34 |

*Primary Examiner*—Davis T. Moorhead

*Attorney, Agent, or Firm*—Richard W. Carpenter

[57] ABSTRACT

A variable depth container with self-locking closure flaps.

1 Claim, 4 Drawing Figures

VARIABLE DEPTH SELF-LOCKING CONTAINER

SUMMARY OF THE INVENTION

This invention relates to containers and more particularly to a container formed of a unitary blank of foldable sheet material such as paperboard which comprises a tubular body having fold lines accommodating a variable depth and having self-locking closure flaps on at least one end of the body.

Although variable depth containers are known in the art, as are self-locking closure flap arrangements, the novelty in the present invention resides in the provision of a container which includes a unique combination of these features.

It is, therefore, an object of this invention to provide a container having a variable depth feature and interlocking closure flaps on at least one end.

A more specific object of the invention is the provision, in a variable depth container, of interlocking closure flaps having separate contour features to accommodate interlocking of the flaps as their dimensions vary with the height of the container.

These and other features of the invention will be apparent from an examination of the following description and drawings.

THE DRAWINGS

It will be understood that, for purposes of clarity, certain elements may have been intentionally omitted from certain views whereby they are believed to be illustrated to better advantage in other views.

THE SPECIFICATION

Figure 1:
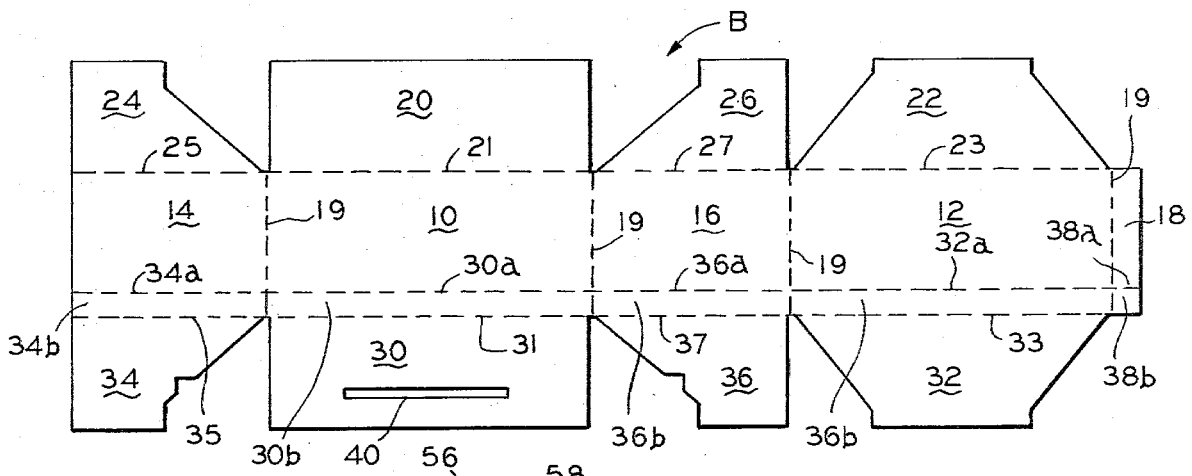
FIG. 1 is a plan view of a blank of foldable sheet material from which the container illustrated in the order views may be formed.
Figure 2:
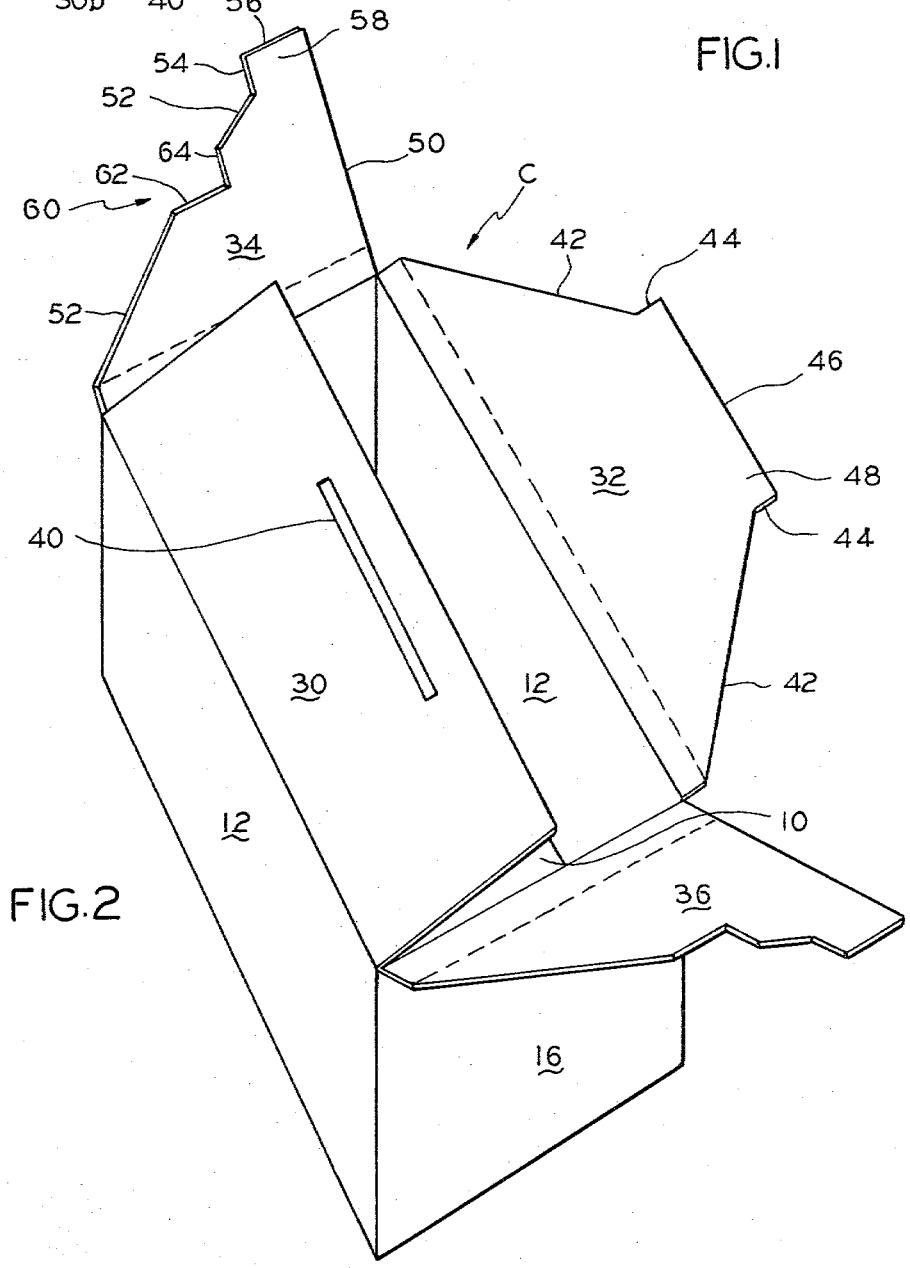
FIG. 2 is a perspective view, as seen from the bottom, of a container embodying features of the invention, and shown with the closure flaps in a partially open position.

Referring now to the drawings for a better understanding of the invention, it will be seen that a novel variable depth container embodying features of the invention and indicated generally at C in FIG. 2 of the drawings, may be formed from a unitary blank B of foldable paperboard illustrated in FIG. 1.

Container C includes a body portion having an opposed pair of first and second major side walls 10 and 12, respectively, an opposed pair of first and second minor walls 14 and 16, respectively, and a glue flap 18, all of which are foldably joined to each other along parallel fold lines 19 to form a tubular structure open at the ends.

The open ends of the container may be closed by closure flap arrangements. In the container illustrated, the upper end of the container is provided with a pair of opposed first and second major closure flaps 20 and 22 foldably joined along fold lines 21 and 23 to the upper edges of major walls 10 and 12, respectively, and a pair of first and second minor closure flaps 24 and 26 which are foldably joined along fold lines 25 and 27 to the upper edges of minor side walls 14 and 16, respectively. The closure flaps are arranged and disposed to be folded into interlocking overlapping relationship to close the upper end of the container. This closure flap arrangement is described for illustrative purposes only, and any other type of closure flap arrangement may be utilized to close this end of the container, because the novel portion of the invention relates to the closure arrangement at the other end of the container.

As best seen in FIG. 2, which is a perspective view of the container as seen from the bottom, the bottom closure arrangement also includes a pair of first and second major closure flaps 30 and 32 which are foldably joined along fold lines 31 and 33 to the lower edges of major fold lines 10 and 12, respectively, and a pair of first and second minor closure flaps 34 and 36 which are foldably joined along fold lines 35 and 37 to the lower edges of minor side walls 14 and 16, respectively. As best seen in FIGS. 1 and 2, bottom closure flaps 30, 32, 34 and 36, as well as glue flap 18, are provided with aligned fold lines **30*a*, 32*a*, 34*a*, 36*a* and 38*a* which are disposed parallel to and spaced inwardly from fold lines 31, 33, 35 and 37 and which define therewith a narrow strap or band, extending around the bottom of the container, which includes sections 30*b*, 32*b*, 34*b* and 38*b***.

Figure 4:
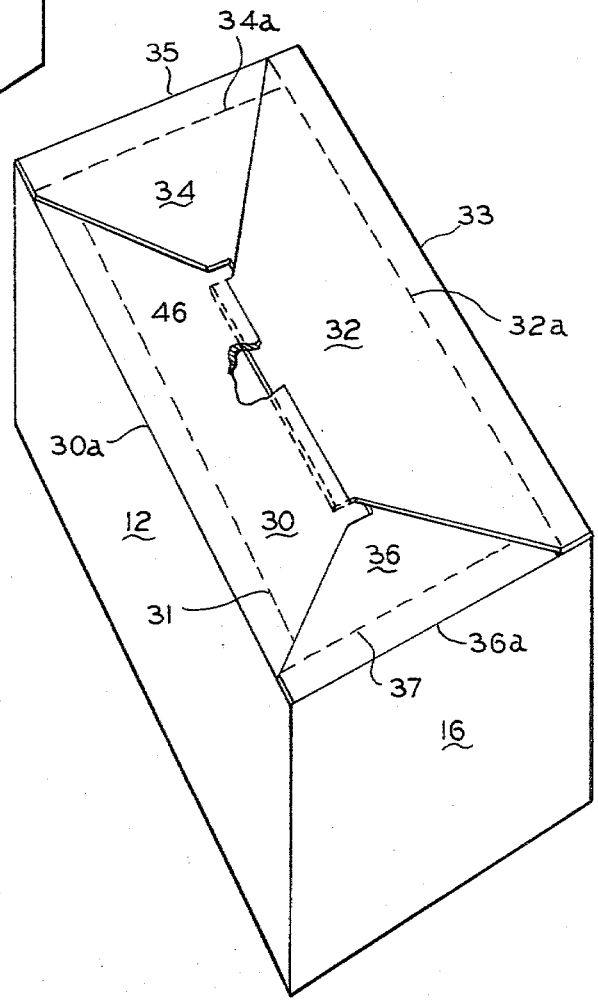
FIG. 4 is a view similar to FIG. 3, but with the container shown at a different depth.

Normally when the box is at full depth, the bottom closure flaps are folded on the outer fold lines 31, 33, 35 and 37; however, when it is desired to reduce the depth of the container, the flaps may be folded on the alternate fold lines **30*a*, 32*a*, 34*a*, 36*a* and 38*a*, as illustrated in FIG. 4**.

Again referring to FIGS. 1 and 2, it will be seen that the first major bottom closure flap 30 is provided with an elongated opening 40, the purpose of which is hereinafter described. Major bottom closure flap 32 is provided with a pair of upwardly converging side edges 42 which join outwardly extending straight edges 44 which cooperate with an outer straight edge 46 to define a projection 48.

Each of the minor bottom closure flaps 34 and 36 are provided with an outer straight edge 50 and another outer sloping edge 52 which extends into an inner straight edge 54 which in turn cooperates with a straight end edge 56 to provide a projection 58.

Additionally, minor bottom closure flaps 34 and 36 are each provided with a recess 60, which is defined by a pair of first and second edges 62 and 64 which converge inwardly from sloping edge 52, as best seen in FIG. 2.

Figure 3:
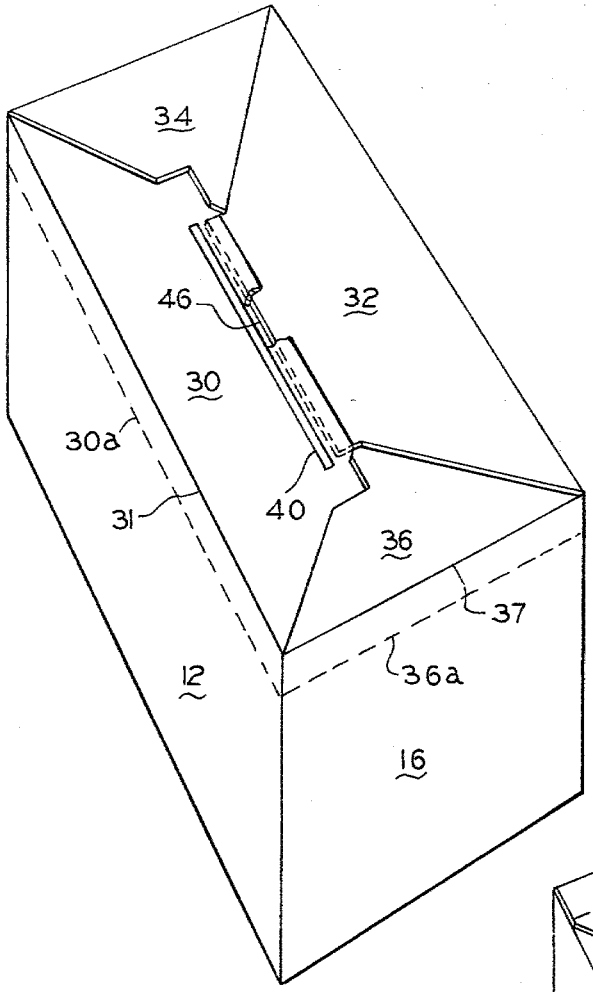
FIG. 3 is a view similar to FIG. 2 but with the flap shown in a closed and locked position.

To describe the operation of the closing arrangement of the container, in FIG. 3 is shown the closure arrangement when the container is at full depth. In FIG. 4 is illustrated the closure arrangement when the container is at less than full depth.

Now referring to FIGS. 2 and 3, for a description of the closure arrangement at full depth. First major flap 30 is folded inwardly about fold line 31 to become an inner flap. Next, minor closure flaps 34 and 36 are folded inwardly about fold lines 35 and 37, respectively, to overlap major flap 30 and to become intermediate flaps. Next, major flap 32 is folded inwardly so as to overlie minor flaps 34 and 36 and become an outer closure flap. As flap 32 is folded over, projection 48 is pushed beyond the free edge of flap 30 and tucked under the marginal portion of flap 30 to provide an interlocking relationship which holds all of the flaps in place. Up to this point, the arrangement described is a conventional self-locking closure arrangement.

The novelty of the invention resides in being able to have this type of closure arrangement with a variable depth container. When the bottom closure flaps are folded on the alternate fold lines 30*a*, 32*a*, 34*a* and 36*a*, not only is the depth of the container reduced, but the dimensions of the bottom closure flaps are increased, each being a distance equal to the distance between the alternate series of fold lines. In order to accommodate the structure to the increased dimension, bottom closure flap 30 is provided with the opening 40 previously mentioned and minor closure flaps 34 and 36 are provided with recesses 60 previously mentioned.

The purpose of opening 40 and recesses 60 is to accommodate the interlocking arrangement of the flaps with their increased dimensions. The flaps are still folded in the same manner as previously described to close the container, except they are folded about the alternate fold lines 30*a*, 32*a*, 34*a*, 36*a* and 38*a*. In this arrangement the projection 48 on outer major closure flap 32 is inserted within opening 40 of inner major closure flap 30. Also, notches 60 in minor closure flaps 34 and 36 accommodate the insertion of projection 48 into opening 40. Without the recesses such could not be accomplished because of the increased dimensions of the flaps.

Thus the invention provides a novel arrangement which permits a self-locking flap closure arrangement with a variable depth container where a positive locking can be obtained with either depth for the container.

We claim:

1. A variable depth container, formed from a unitary blank of foldable paperboard, with a self-locking closure arrangement, said container comprising:

(a) opposed pairs of major and minor side walls foldably interconnected to form a tubular body open at the ends;

(b) integral closure means for at least one end of said tubular body including opposed pairs of major and minor closure flaps foldably joined to corresponding edges of respective major and minor side walls of said body along aligned first fold lines;

(c) said major walls having aligned second fold lines disposed parallel to and spaced inwardly from said first fold lines to define therewith a plurality of aligned strips which are adapted to become portions of related closure flaps to permit the depth of said container to be reduced by alternatively folding said flaps on said second fold lines instead of on said first fold lines;

(d) said closure flaps being arranged for interlocking engagement when folded normal to said body side walls, with said first major flap being an inner flap, said second major flap being an outer flap, and said minor flaps being intermediate flaps between said inner and outer flaps;

(e) certain of said flaps having contour features for receiving portions of other flaps to accommodate interlocking engagement therebetween when said flaps are folded on said first fold lines and having additional contour features for receiving other portions of said other flaps to accommodate interlocking engagement therebetween when the dimensions of said flaps are increased by being folded on said second fold lines to reduce the depth of said container;

(f) said first major closure flap having an opening for receiving a projection of said second major closure flap when the depth of the container is reduced;

(g) said minor closure flaps having recesses for receiving portions of at least one of said major closure flaps when the depth of the container is reduced.

* * * * *